United States Patent [19]

Hiyoshi et al.

[11] 4,133,244

[45] Jan. 9, 1979

[54] ELECTRONIC MUSICAL INSTRUMENT WITH ATTACK REPEAT EFFECT

[75] Inventors: Teruo Hiyoshi; Akira Nakada; Shigeru Yamada, all of Hamamatsu; Kiyoshi Ichikawa, Hamakita; Shigeki Ishii, Hamamatsu, all of Japan

[73] Assignee: Nippon Gakki Seizo Kabushiki Kaisha, Hamamatsu, Japan

[21] Appl. No.: 714,083

[22] Filed: Aug. 13, 1976

[30] Foreign Application Priority Data

Aug. 21, 1975 [JP] Japan ..... 50-101599

[51] Int. Cl.[2] ..... G10H 1/02

[52] U.S. Cl. ..... 84/1.26; 84/1.13; 84/1.17; 84/1.24

[58] Field of Search ..... 84/1.01, 1.03, 1.13, 84/1.17, 1.24, 1.26, DIG. 4

[56] References Cited

U.S. PATENT DOCUMENTS 4,033,219 7/1977 Deutsch ..... 84/1.26 X

*Primary Examiner*—Ulysses Weldon

*Attorney, Agent, or Firm*—Spensley, Horn & Lubitz

[57] ABSTRACT

An electronic musical instrument capable of producing an attack repeat effect. The attack repeat effect is a musical effect produced by repeated occurrences of attack and decay during a single continued sounding of a musical tone, giving to an audience an impression as if the tone started and stopped repeatedly. According to the invention, a complete envelope shape starting by an attack portion and ending by a decay portion is stored in a memory. When a key on the keyboard is depressed, the stored envelope shape is read from the memory and, upon completion of reading of one cycle of the envelope shape, reading of the envelope shape is resumed from the beginning. A time division multiplexed reading out of the envelope shape is conducted with respect to a plurality of channels. The read out envelope shape is used for controlling the amplitude of the musical tone signal. If the key is released, reading of the envelope shape is no longer repeated for a next and subsequent cycles.

4 Claims, 5 Drawing Figures

FIG.2
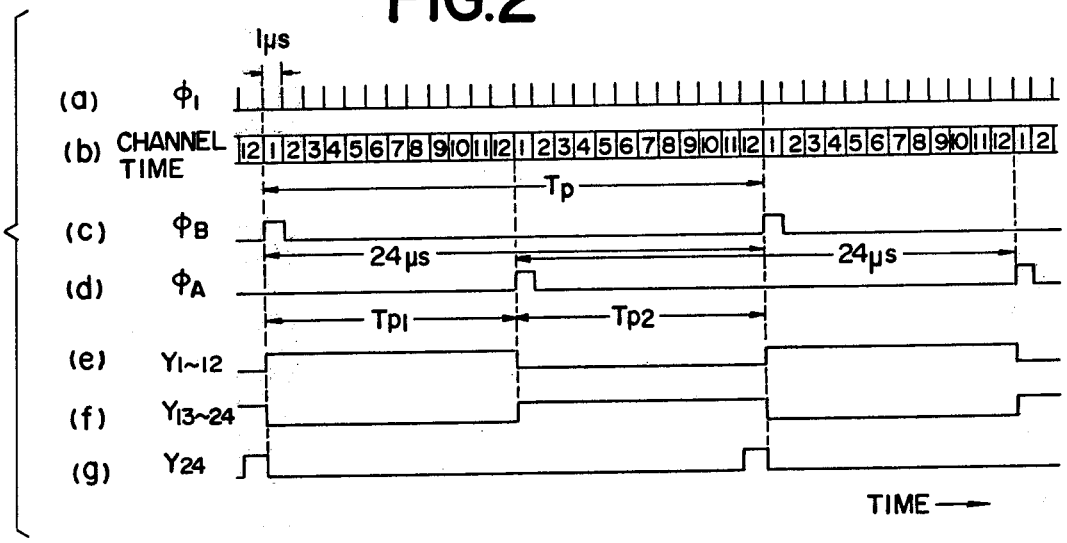
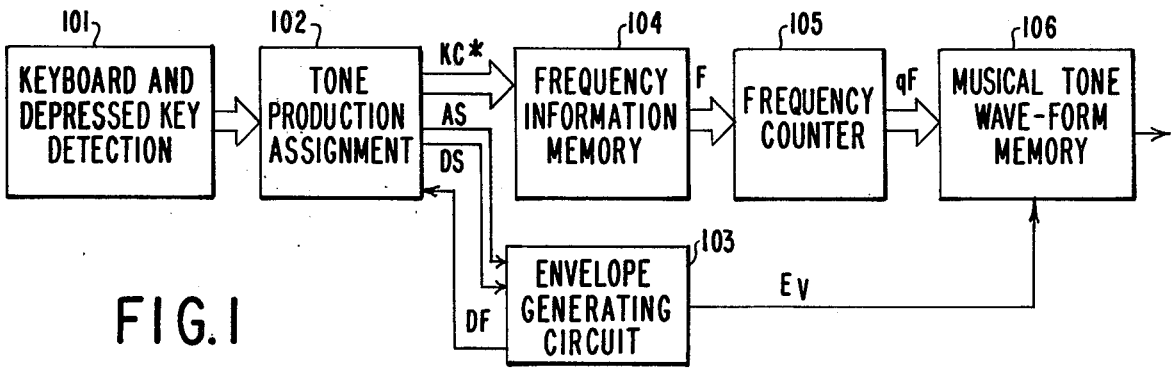
FIG.1

ELECTRONIC MUSICAL INSTRUMENT WITH ATTACK REPEAT EFFECT

BACKGROUND OF THE INVENTION

This invention relates to an electronic musical instrument and, more particularly, to an electronic musical musical instrument capable of repeatedly producing the same amplitude envelope of a musical tone.

The amplitude envelope of a musical tone herein signifies a series of temporal change of a musical tone amplitude from the start of generation of the musical tone to the end of it. The series of the envelope shape includes at least an attack portion or a rise portion of the tone and a decay portion or a fall portion thereof. When a tone is sounded, its amplitude envelope normally starts from the attack portion and ends in the decay portion. There occurs a case, however, where performance of a musical piece requires a musical effect which may be termed an "attack repeat effect." This musical effect can be obtained by producing an envelope shape starting from the attack and ending in the decay repeatedly during a single continued production of a musical tone and controlling the amplitude of the musical tone by such envelope shape. The attack repeat effect is a musical effect which gives an impression as if the tone being played stopped and started periodically in succession.

There is a prior art electronic musical instrument which can produce such attack repeat effect by employing a time constant circuit comprising a capacitor and a resistor for generating an envelope shape. In the prior art instrument, electronic charge must be supplied periodically to this time constant circuit for repeatedly producing the envelope shape. The envelope obtainable by the prior art instrument is limited in its shape. Moreover, if a multi-channel system is used, the prior art instrument requires the time constant circuit for each of the plural channels resulting in an extremely complicated construction.

SUMMARY OF THE INVENTION

It is, therefore, an object of the present invention to provide an electronic musical instrument which has eliminated the above described disadvantages of the prior art instrument by achieving the attack repeat effect for each of a plurality of channels with a very simple construction.

According to the invention, the attack repeat effect is obtained in an electronic musical instrument of a type wherein the envelope shape is previously stored in a suitable type of memory and relative amplitudes of the envelope shape are successively read from this memory for controlling the amplitude envelope of the musical tone. The envelope shape is divided into a plurality of sample points and relative amplitudes at the respective sample points are stored at corresponding addresses in the memory. The attack starts by successively reading out the relative amplitudes from the first address and the decay finishes by reading out the relative amplitude at the final address. The instrument is so controlled that, upon detection of the fact that reading of the contents of the memory has reached the final address, reading of the envelope shape is resumed from the first address without stopping the production of the tone. By this arrangement, the same envelope shape is repeatedly read out during a single continued production of the tone (i.e. during a single continued depression of the key) and the attack and decay occur repeatedly and periodically in the amplitude envelope. Accordingly, the attack repeat effect is realized. this attack repeat effect can be obtained with respect to each of a plurality of channels.

The above described and other objects and features of the invention will become apparent from the description made hereinbelow with reference to the accompanying drawings.

BRIEF DESCRIPTION OF THE DRAWINGS

FIG. 1 is a block diagram schematically showing the electronic musical instrument according to the invention;

FIGS. 2(*a*) through 2(*g*) are timing charts illustrating relations between clock pulses used in the instrument;

DESCRIPTION OF A PREFERRED EMBODIMENT

Figure 3:
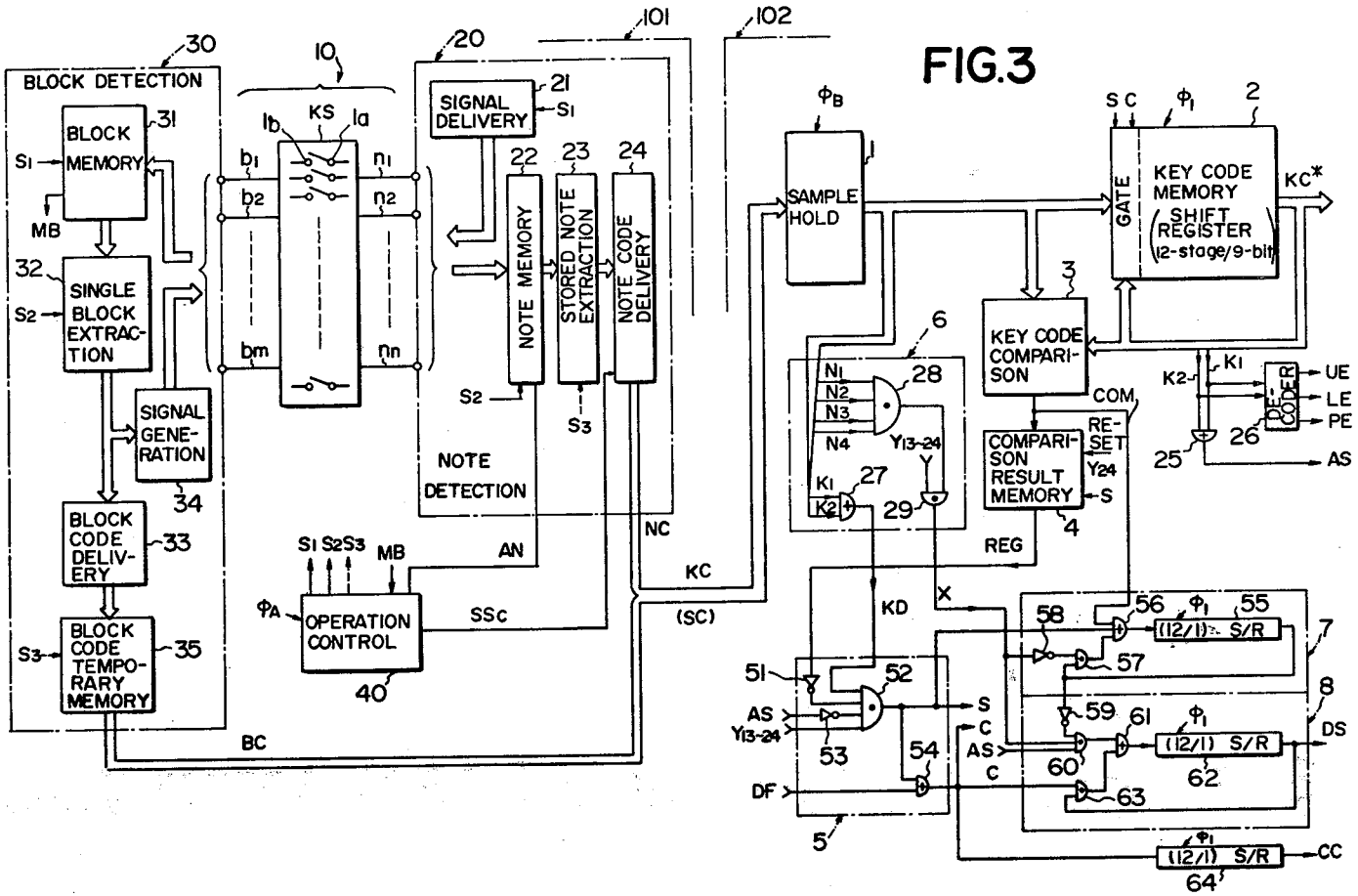
FIG. 3 is a block diagram showing an example of a keyboard and depressed key detection circuit and a tone production assignment circuit in FIG. 1.

Referring to FIG. 1, an important feature of the invention resides in the specific construction of an envelope generating circuit 103. However, for facilitating understanding of the entire musical instrument, component parts other than the envelope generating circuit 103 will first be described.

A keyboard and depressed key detection circuit 101 detects ON-OFF states of key switches of the keys disposed on the keyboard and thereupon produces information identifying the depressed keys. A tone production assignment circuit 102 receives the information identifying the depressed keys and assigns production of tones of the depressed keys to some of the channels corresponding in number to a maximum number of tones to be produced simultaneously (e.g. 12 tones) in accordance with the key identifying information. In accordance with this assignment, the assignment circuit 102 produces key codes representing the depressed keys and other information including information indicating whether the key assigned to the specific channel has been depressed or released. The key codes KC* provided by the assignment circuit 102 are supplied to a system including a frequency information memory 104, a frequency counter 105 and a musical tone waveform memory 106 for producing musical tone signals of frequencies designated by the depressed keys. Information AS and DS representing depression and release of the keys respectively is supplied to an envelope generating circuit 103 for producing an amplitude envelope shape of the musical tone signal.

For achieving the purpose of producing plurality of musical tones simultaneously, the present embodiment has a construction based on so called "dynamic logics"

so that the counters, logical circuits and memories provided therein are used in a time-sharing manner. Accordingly, time relations between clock pulses controlling the operations of these counters etc. are very important factors for their operation. The relations between the clock pulses used in the invention device are shown in FIGS. 2(*a*) through 2(*g*). A master clock pulse $\phi_1$ of FIG. 2(*a*) is a pulse controlling the time division operation of the respective channels and a clock pulse $\phi_B$ in FIG. 2(*c*) is a pulse controlling the assignment operation in the key assignment circuit 102. A clock pulse $\phi_A$ which has a phase shifted by 180° from the clock pulse $\phi_B$ is used in a depressed key detection circuit 101. Detailed explanation about FIGS. 2(*a*)–2(*g*) will be made later.

DETECTION OF DEPRESSED KEYS AND TONE REPRODUCTION ASSIGNMENT

FIG. 3 shows an example of the keyboard and depressed key detection circuit 101 and the tone production assignment circuit 102. In FIG. 3, the keyboard and depressed key detection circuit 101 generates a key code KC representing a depressed key and may therefore be called a key coder. Further, the tone production assignment circuit 102 assigns reproduction of the tones of the depressed keys to any of the channels and may be called a channel processor. In the following description, these circuits are referred to as "key coder 101" and "channel processor 102" respectively.

In the key coder 101, a number of key switches KS are divided into a plurality of key switch groups (each of the groups is called a "block") and a note (identifying code) indicative of a position of each individual key switch in each block is assigned to such position of the key switch. Each single key switch among all key switches KS can be identified by combination of the block and the note. The key switches KS of the same note are commonly connected at one terminal (movable contact) 1*a* and further connected to one of conductors $n_1$–$n_n$ corresponding to the respective notes (e.g. 12 notes of C, C#, D . . . B), whereas the key switches of the same block (e.g. a group by keyboard, octave etc.) are commonly connected at the other terminal (stationery contact) 1*b* and further connected to one of conductors $b_1$–$b_m$. The key switch circuit 10 is constructed in the above described manner. Alternatively stated, the key switches KS are disposed in matrix of columns of the block conductors $b_1$–$b_m$ and rows of the note conductors $n_1$–$n_n$. If the total number of the key switches KS is m x n, the required number of conductors is a sum of the number of the blocks and the number of the notes, i.e. m + n. The key switches KS are connected at one terminal thereof to the note detection circuit 20 via the note conductors $n_1$–$n_n$ and at the other terminal thereof to the block detection circuit 30 via the block conductors $b_1$–$b_m$.

Detection of all the key switches in operation is completed by successive implementation of several different detection operation modes (hereinafter referred to as "operation mode" or "mode").

In the first operation mode, a signal from the signal delivery circuit 21 of the note detection circuit 20 (e.g. a signal "1") is applied simultaneously and in parallel to the mobable contact side of all of the key switches through the conductors $n_1$–$n_n$ and this signal is passed only through the closed contact of the key switch or switches in operation to a corresponding one of the conductors $b_1$–$b_m$. The detected signal is stored in a block memory 31 of the block detection circuit 30. By this arrangement, the block or blocks in which the key switch or switches in operation exist are detected. The storing of the detected key switches, is made in synchronization with a first mode signal S, designating the first mode.

In the second mode, a single block among the blocks stored in the memory 31 is extracted by a single block extraction circuit 32 and thereupon a signal from a signal generation circuit 34 is applied through one of the conductors $b_1$–$b_m$ corresponding to the extracted block to the stationery contacts of the respective key switches of the extracted block. The signal is passed to one of the conductors $n_1$–$n_n$ connected to the movable contacts of the respective key switches for notes covered by the extracted block and corresponding to the key switches in operation. This signal is stored in a note memory 22 of the note detection circuit 2. Accordingly, which one or ones of the key switches in the extracted block are in operation is detected. The extracting operation in the single block extraction circuit 32 and the storing operation in the note memory 22 are performed in synchronization with a second mode signal $S_2$ designating the second mode.

In the third mode which succeeds to the second mode, a single one among the notes stored in the note memory 22 in the second mode is extracted by a stored note extraction circuit 23, and a signal representing the extracted note is applied to a note code delivery circuit 24 to produce a code signal (note code NC) consisting of plural bits and representing the note. The extracting operation in the extraction unit 23 is performed in synchronization with a third mode signal $S_3$. For example, the contents of storage in the note memory circuit 22 stored when the second mode signal $S_2$ is applied are read out at a timing of the third mode signal $S_3$ and one of the read out notes is extracted by the extraction circuit 23 and then applied to the note code delivery circuit 24. Simultaneously, storage of the extracted notes are cleared from the note memory circuit 22. At a next timing of the third mode signal $S_3$, the contents of storage in the note memory circuit 22 are read out and a different one of the stored notes is extracted by the extraction circuit 23. Thus, extraction is continued in accordance with the third mode signal $S_3$. This third mode is repeated in response to the third mode signal $S_3$(clock $\phi_A$) until the note signals stored in the note memory 22 have all been extracted by the note extraction unit 23 and corresponding note code signals have all been delivered out. It should be mentioned here that the first mode signal $S_1$, the second mode signal $S_2$ and the third mode signal $S_3$ have a pulse width equivalent to the interval of the clock $\phi_A$(i.e. 24 μs in FIG. 2). Since the third mode is implemented only with respect to the notes stored in the note memory 22, there is no room for occurrence of waste of time. Completion of the third mode can be known by exhaustion of the contents stored in the note memory 22 due to extraction and, by applying a signal AN representing that no note is stored in the circuit 22 to an operation control circuit 40, the second mode signal $S_2$ is produced by the circuit 40. Thereupon the mode is returned to the second mode, the single block extraction circuit 32 extracting a next stored block and the note memory 22 memorizing the notes of the key switches in operation in that block. Then the third mode is implemented again. In the third mode concerning a certain block, a code signal (block code BC) consisting of plural bits and representing the block extracted by the circuit 32 is applied from the block code delivery circuit 33 to a block code temporary memory circuit 35 and stored therein. Accordingly, key switches in operation are detected in the third mode by combinations of the block codes BC and the note codes NC which are generated in sychronization with each other.

As described above, the operation mode changes from the first mode to the second mode, third mode (or repetition thereof), second mode, third mode . . . When implementation of the second and third modes have been completed with respect to all of the blocks stored first in the block memory 31, the contents of storage in the block memory 31 have all been extracted and the operation mode now enters a fourth or stand-by modes. This can be known by a signal MB representing that the stored blocks in the block memory circuit 31 have all been extracted and exhausted and the signal AN representing exhaustion of the stored notes. Accordingly, when the signals MB and AN have ceased to be produced (i.e. when they have become "0") during implementation of the third mode, the operation control circuit 40 designates the fourth mode at a timing of a next clock $\phi_A$. After detection of the stand-by mode, the first mode signal $S_1$ is produced at a suitable timing and the operation mode returns to the first mode. Then the above described detection operation is repeated. By repetition of the first to the fourth modes, detection of all of the key switches in operation is completed.

The stored blocks or the stored notes may be extracted one by one in a predetermined order of priority by incorporating a priority gate circuit in the block extraction circuit 32 or the stored note extraction circuit 23. The block code delivery circuit 33 and the note code delivery circuit 24 may respectively be constructed of a suitable type of encoder.

The note code NC provided by the note detection circuit 20 and the block code BC provided by the block detection circuit 30 constitute key code KC representing the key switch in operation which is applied to the channel processor 102.

A clock used for controlling the operation in the key coder 101 is a clock pulse $\phi_A$ which is produced at an interval of 24 μs as shown in FIG. 2(*d*). Accordingly, interval of generation of each key code KC generated in the key coder 101 is 24 μs. In the channel processor 102, the key code KC provided by the key coder 101 is applied to a sample hold circuit 1 in which it is sampled and held at a timing of the clock pulse $\phi_B$ shown in FIG. 2(*c*) This holding period, i.e. the interval of clock pulse $\phi_B$, is equivalent to operation time Tp in which a single assignment operation is performed in the channel processor 102. The clock pulses $\phi_B$ and $\phi_A$ are different in phase by 180°. This difference in phase is provided for generating the clock $\phi_B$ curing period when the key code KC maintains a constant value under a stable condition and thereby loading an accurate value in the sample hold circuit 1.

Relations between the key code KC and the key names (note names) corresponding thereto are shown in the following table.

Table I

| | | key codes T | | | | | | | | |
|---|---|---|---|---|---|---|---|---|---|---|
| | | block codes BC | | | | | note codes NC | | | |
| | | K2 | K1 | B3 | B2 | B1 | N4 | N3 | N2 | N1 |
| | U | 0 | 0 | | | | | | | |

Table I-continued

| | | key codes T | | | | | | | | |
|---|---|---|---|---|---|---|---|---|---|---|
| | | block codes BC | | | | | note codes NC | | | |
| | | K2 | K1 | B3 | B2 | B1 | N4 | N3 | N2 | N1 |
| | keyboard L | 1 | 0 | | | | | | | |
| | P | 1 | 1 | | | | | | | |
| block | | | | | | | | | | |
| | 0 | | | 0 | 0 | 0 | | | | |
| | 1 | | | 0 | 0 | 1 | | | | |
| | octave 2 | | | 0 | 1 | 0 | | | | |
| | 3 | | | 0 | 1 | 1 | | | | |
| | 4 | | | 1 | 0 | 0 | | | | |
| | 5 | | | 1 | 0 | 1 | | | | |
| | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |
| | start code sc | 0 | 0 | 0 | 0 | 0 | 1 | 1 | 1 | 1 |

The key code KC is composed of a code $K_2$, $K_1$ representing the kind of the keyboard, a code $B_3$, $B_2$, $B_1$ representing the octave range and a code $N_4$, $N_3$, $N_2$, $N_1$ representing the note name. Each individual key switch is identified by a combination of these codes. As to the keyboard, an upper keyboard UK, a lower keyboard LK and a pedal keyboard PK are used. Each keyboard has six octaves ranging from 0th octave to the fifth octave. The tone range of the pedal keyboard, however, is normally two to three octaves. One octave includes 12 key switches of C#, D, D# . . . B and C.

In the key coder 101, the block code BC consists of the codes representing the keyboard and the octave, i.e. bits $K_2$, $K_1$, $B_3$, $B_2$, $B_1$ whereas the note code NC consists of bits $N_4$, $N_3$, $N_2$, $N_1$.

The start code SC is produced when a start designation signal SSc is supplied from the operation control circuit 40 to the note code delivery circuit 24. As will be apparent from Table I, the less significant bits $N_4$, $N_3$, $N_2$, $N_1$ of the start code SC are all "1" so that, when the start code SC is applied, the outputs of the note code delivery circuit 24 are all "1." The start code designation signal SSc is produced in such a manner that it is generated by the operation control circuit 40 when the key coder KC is in the stand-by mode. Accordingly, the key code KC is never produced concurrently with the start code SC and at this time the respective bits $K_2$, $K_1$, $B_3$, $B_2$, $B_1$ of the block code BC are all "0." Accordingly, the start code designation signal SSc need not be applied to the block code delivery circuit 33. As will be apparent from Table I, the start code SC can be distinguished from the key code KC representing the detected key switch in operation.

The start code designation signal SSc is produced substantially regularly every time the count of a control counter (not shown) in the operation control circuit 40 has amounted to a predetermined value. The control counter counts a low frequency clock pulse with a pulse period of 200 μs to 1 ms and the start code designation signal SSc is produced in synchronization with the stand-by mode every time the counter has counted eight shots of the pulse. This start code designation signal SSc lasts for one period of the clock pulse $\phi_A$ (i.e. 24 μs). Accordingly, the signal SSc is produced with an approximately regular interval of 2 ms to 8 ms. The start code SC appears on a delivery line of the key code KC in response to the signal SSc and is applied to the sample hold circuit 1. This start code SC is utilized for key-off detection in the channel processor 102.

The channel processor (tone production assignment circuit) 102 is provided for assigning production of a designated tone to any one of the channels corresponding in number to the maximum number of tones to be produced simultaneously in response to the operation of the key switch KSS. Conditions of assignment are:

(A) There is a channel (an empty channel) to which production of tone has not been assigned yet; and (B) The same tone should not be assigned to a plurality of channels.

In the channel processor 102, a key code memory circuit 2 comprises storage positions corresponding in number to the number of the channels and includes a gate circuit in the input side thereof. The memory circuit may conveniently be constructed of a circulating shift register. If the number of the channels is 12 and the key code KC consists of 9 bits, a shift register having 12 storage positions with one storage position having a capacity of 9 bits (i.e. 12 stage-9 bit) is employed. The key code stored in the respective storage positions is successively shifted in accordance with the master clock pulse $\phi_1$ (FIG. 2(*a*)) and delivered out of the final stage of the shift register while it is fed back to the input side thereof. The interval of generation of the master clock pulse $\phi_1$ is 1 $\mu$s which is hereinafter referred to as "channel time." Assuming that the number of the channels is 12, time slots of a time width of 1 $\mu$s divided by the master clock pulse $\phi_1$ corresponds to the first to the twelfth channels. As shown in FIG. 2(*b*). The respective time slots are called the first channel, the second channel, . . . the twelfth channel. The respective channel times occur cyclically and, accordingly, the key code memory circuit 2 produces the stored key codes KC* for the key switches assigned to the respective channels in a time shared fashion in synchronization with the respective channel times.

The clock pulse $\phi_B$ which constitutes a single assignment operation time Tp is produced at the first channel time when each channel time has circulated twice (FIG. 2(*c*)). The single assignment operation time Tp is divided into a former one circulation period $Tp_1$ and a latter one circulation period $Tp_2$. The former period $Tp_1$ is designated by a pulse $Y_{1-12}$ as shown in FIG. 2(*e*) and the latter period $Tp_2$ by a pulse $Y_{13-24}$ as shown in FIG. 2(*f*). A pulse $Y_{24}$ shown in FIG. 2(*g*) is generated at the end of the assignment operation time Tp, namely at the twelfth channel of latter period $Tp_2$.

A key code comparison circuit 3 compares the key code KC provided by the key coder 101 with the stored key code KC* provided by the key code memory circuit 2 and produces a result of comparison COM in accordance with coincidence or non-coincidence between the two input signals. The key code KC is applied from the sample hold circuit 1 without variation during the single assignment operation time Tp. In the meanwhile, the contents of the stored key codes KC* assigned to the first to the twelfth channels circulate twice during this time Tp. Accordingly, comparison with the contents of the respective stored key codes KC* is completed in the former period $Tp_1$. The above described condition (B) for the assignment is detected by this comparison. The result of comparison COM is "1" when there is coincidence and "0" when there is no coincidence.

A comparison result memory circuit 4 stores the result of comparison COM and holds this result of comparison COM during the latter period $Tp_2$ until it is reset by a pulse $Y_{24}$ (FIG. 2). A comparison result register signal REG is applied to an inverter 51 of a set and reset signals generation circuit 5 and applied to an AND gate 52 after being inverted by the inverter 51.

The set and reset signals generation circuit 5 generates a set signal S and a reset signal C upon detecting that the above described conditions of the assignment (A) and (B) are both satisfied. The set signal S and the reset signal C are applied to the input gate of the key code memory circuit 2 for controlling the gate in such a manner that the input key code KC from the sample hold circuit 1 is stored in the circuit 2. The above condition (A) can be recognized by detecting presence or absence of the key code KC* stored in the memory circuit 2. More specifically, presence or absence of the key code KC* produced at every channel time by the key code memory circuit 2 is watched by an OR gate 25 for detecting whether the key code is stored or not. Since either one of the bits $K_2$, $K_1$ of the key code is "1" as will be observed from the Table I, signals of the bits $K_2$, $K_1$ are applied to the OR gate 25. At a channel time at which the stored key code KC* exists, an output AS of the OR gate 25 is a signal "1," representing that reproduction of the tone has been assigned to the channel. At a channel time at which the stored key code KC* is absent, the output AS is "0" representing that there is an empty channel. Accordingly, the fact that the signal AS is "0" means that the above condition (A) is satisfied. This signal AS is inverted by the inverter 53 of the set and reset signals generation circuit 5 and thereafter applied to the AND gate 52.

This output AS is also utilized in an envelope generation circuit 103 to be described later as a key-on signal AS which designates a channel in which a tone is to be reproduced (i.e. representing depression of the key).

A code detection circuit 6 watches the contents of the code signal held in and provided by the sample hold circuit 1 and produces a key code generation detection signal KD if the contents delivered from the circuit 1 are the key code KC, whereas it produces a key-off examination signal X if the contents delivered from the circuit 1 are the start code SC. Since either one of the bits $K_2$, $K_1$ of the key code KC is "1," these bits $K_2$, $K_1$ are applied to the OR gate 27 and the output "1" of the OR gate 27 is used as the key code generation detection signal KD. Further, since the bits $N_4$, $N_3$, $N_2$, $N_1$ of the start code SC are all "1," the signal "1" of these bits are detected by an AND gate 28 and output of the AND gate 28 is selected by an AND gate 29 only during appearance of the pulse $Y_{13-24}$ (FIG. 2) so that the key-off examination signal X is produced only during the latter period $Tp_2$. If the above described regular start code SC is not produced by the key coder 101, the key-off examination signal X may be generated by the code detection circuit 6 alone in response to a suitable low frequency clock.

If a new key is depressed on the keyboard, the key switch for the key is operated (i.e. becomes key-on) and the key code KC representing the key switch is applied from the key coder 101 to the channel processor 102. This key code KC has not been stored in the key code memory circuit 2 yet so that the output COM of the comparison circuit 3 is a signal "0" during the former period $Tp_1$ (FIG. 2). Accordingly, the output REG of the comparison result memory circuit 4 is a signal "0" during the latter period $Tp_2$. This signal REG is inverted into a signal "1" and thereafter applied to the AND gate 52. At this time, the key code generation detection signal KD is applied to the AND gate 52 from the OR gate 27. Furthermore, the pulse $Y_{13-24}$ designating the latter period $Tp_2$ is also applied to the AND gate 52. Accordingly, the AND gate 52 is enabled when the signal AS become "0" in the latter period $Tp_2$. More specifically, the signal AS becomes "0" at the earliest channel time of an empty channel in the latter period $Tp_2$ (in the order of the first to the twelfth channel) and the inverted signal AS becomes "1" so that the AND gate 52 is enabled to produce a signal "1" at that channel ttime. This signal "1" constitutes the set signal S and also the reset signal C through an OR gate 54. When the set signal S is produced, the storage in the comparison result memory circuit 4 is compulsorily set at "1." As a result, the signal REG becomes "1" and its inverted signal $\overline{REG}$ becomes "0" thereby inhibiting the AND gate 52. Owing to this arrangement, the set signal S is produced only at a single channel time even if there are plural empty channel times.

The set signal S instructs that the key code KC from the key coder 101 (held in the sample hold circuit 1) be assigned to the channel time at which this set signal S has been generated (i.e. the key code be stored in the circuit 2). When the new assignment has been instructed by the set signal S, the contents stored in the channel are rewritten by the input key code KC. Data (KC*) fed back from the final stage output are inhibited at the input gate of the memory circuit 2 by the reset signal C and the input key code KC is written by the set signal S in the first storage position of the memory circuit (shift register). The stored key code KC* is successively shifted in accordance with the clock $\phi_1$ and delivered out of the final stage and also fed back to the input side thereof 12 $\mu$s later. Since the reset signal C has already become "0" at this time, the fed back data (KC*) are loaded in the first storage position of the shift register. Thus, the stored key code KC* is cyclically held and also delivered out in a time shared fashion. The same significant bits $K_2$, $K_1$ of the key code KC* which are delivered out are applied to the decoder 26 in which they are decoded on the output line corresponding to the kind of the keyboard. If the bits $K_2$, $K_1$ are "0," the upper keyboard signal UE is produced. If the bits $K_2$, $K_1$ are "10," the lower keyboard signal LE is produced. If the bits $K_2$, $K_1$ are "11," the pedal keyboard signal PE is produced. These keyboard signals are used for controlling musical tones keyboard by keyboard in a circuit for generating musical tones and the envelope generation circuit 103.

A key-on temporary memory circuit 7 comprises a 12-stage/1-bit shift register 55, the respective stages of the shift register 55 substantially corresponding to the respective channels. By storing the key code, this memory circuit 7 is provided for temporarily storing the channel to which reproduction of the tone has been assigned (i.e. key-on) only during the regular period of generation of the start code SC when a key is depressed and the set signal S for storing the key code KC corresponding to the depressed key is produced by the AND gate 52. The set signal S is applied to the shift register 55 through the OR gate 56 causing a signal "1" to be stored in the corresponding channel. This signal is delayed by 12 $\mu$s by the clock $\phi_1$ and delivered out of the final stage of the shift register 55 at the particular channel time. This output signal is applied to an AND gate 57 and fed back to the input side of the shift register 55 via an OR gate 56. The AND gate 57 also receives a signal $\overline{X}$ obtained by inverting the key-off examination signal X by the inverter 58. Normally (when the key code KC is being generated), the output of the inverter 58 is "1" so that the contents of the shift register 55 are held. When the key-off examination signal X has been generated, the AND gate 57 is inhibited and all the contents stored in the channels of the shift register 55 are reset. This is because the key-off examination signal X is generated in the latter period $Tp_2$. In the above described manner, the key-on signal stored in the key-on temporary memory circuit 7 is reset substantially regularly by the signal X.

If the key is continuously depressed, the key code KC for the key is generated many times by the key code 101 so that the key code KC which is identical with the key code KC* already stored in the key code memory circuit 2 is held in the sample hold circuit 1. If the key code KC from the key coder 101 which has been held in the sample hold circuit 1 coincides with a stored key code KC* of a certain channel, the comparison result signal COM at this channel time becomes "1". This signal COM (="1") is applied to the shift register 55 via the OR gate 56 of the key-on temporary memory circuit 7 and sets again the storage of this channel which has once been reset by the key-off exaination signal X. Accordingly, when the next key-off examination signal X is generated, a signal "1" has been stored in the particular channel of the shift register 55. It will be understood from the above description that even if the contents stored in the key-on temporary memory circuit 7 are once reset by the key-off examination signal X, a signal "1" is stored in the particular channel again by generation of a next signal X so long as the key continues to be depressed.

The output of the shift register 55 is supplied to a key-off detection memory circuit 8 in which it is applied to an AND gate 60 via an inverter 59. Detection of the key-off condition is performed at the time when the key-off detection signal is generated. In other words, the key-off detection is performed substantially regularly in accordance with the substantially regular production of the start code SC.

Conditions for detection of key-off are:

(1) The key code KC* of the key switch has already been assigned (i.e. the key-on signal AS=1); but (II) The key code is not stored in the particular channel of the key-on temporary memory circuit 7 (i.e. the output of the shift register 55 is "0"); and (III) The above conditions (I) and (II) are satisfied when the key-off examination signal X is generated (i.e. the signal X = 1).

Recognition of the above conditions (I), (II) and (III) is implemented by an AND gate 60 of the key-off detection memory circuit 8.

When the depressed key has been released, the key code KC representing the key is no longer generated from the key coder 101. Accordingly, a result of comparison representing coincidence of the key code (i.e. COM=1) is not produced by the comparison circuit 3 at the channel time to which the stored key code KC* is assigned. The key-on storage of the particular channel therefore is not set in the key-on temporary memory circuit 7 during a period after the storage of the circuit 7 has been reset by the key-off examination signal X until generation of the next key-off examination signal X. Thus, when the key-off examination signal X is generated, a signal provided by the shift register 55 at the channel time to which the key code KC* of the released key is assigned is "0". This signal "0" is inverted by an inverter 59 and thereafter applied to the AND gate 60. At this time the AND gate 60 receives also the key-off examination signal X instructing the key-off detection operation (during the latter period $Tp_2$) and the key-on signal AS signifying that production of the tone has been assigned to the particular channel. The AND gate 60 therefore is enabled at the channel time at which the key has been released and produces a signal "1" at this channel time. This signal "1" is stored in the shift register 62 via the OR gate 61. In this manner, the key-off has been detected and the key-off signal is stored.

The shift register 62 is of the same construction as the shift register 55 and the output of the final stage thereof is utilized in the envelope generation circuit 103 as the key-off signal DS. The key-off signal DS represents when it is "1" that the key assigned to the particular channel has been released and instructs that the reproduced tone should start to decay. The output of the shift register 62 is fed back to the input side thereof through the AND gate 63 and the OR gate 61 and held in the shift register 62. Since the AND gate 63 is inhibited by the reset signal C from the OR gate 54, the key-off storage in the shift register 62 is cleared at the channel at which the reset signal C has been generated.

The reset signal C delivered out with the set signal S is a signal used for rewriting the contents of the memory circuit 2, whereas the reset signal C provided alone is a signal used for clearing the contents of the memory 2. When production of the tone in the channel has been completed (i.e. when decay of the tone has finished), a decay finish signal DF is provided by the envelope generation circuit 103. This signal DF is applied to the OR gate 54 of the channel processor 102 thereby causing the OR gate 54 to produce the reset signal C. The stored key code KC* or the key-off signal DS is cancelled by this reset signal C and the channel becomes empty. The reset signal C is applied also to a 12-bit shift register 64 and, after being delayed by 12 μs, is used in the poststage circuit.

The above description about construction of the key coder used as the keyboard and depressed key detection circuit 101 and the channel processor used as the tone production assignment circuit 102 has been made only by way of example and these circuits may be composed in a different way.

The signals KC*, UE, LE, PE, AS, DS and CC produced in the tone reproduction assignment circuit (channel processor) 102 are all time division multiplexed signals produced in synchronism with the respective channel times. Accordingly, a channel to which specific data belong can be identified by the channel time (FIG. 2(*b*)) at which the data exist.

PRODUCTION OF ATTACK REPEAT EFFECT

Figure 4:
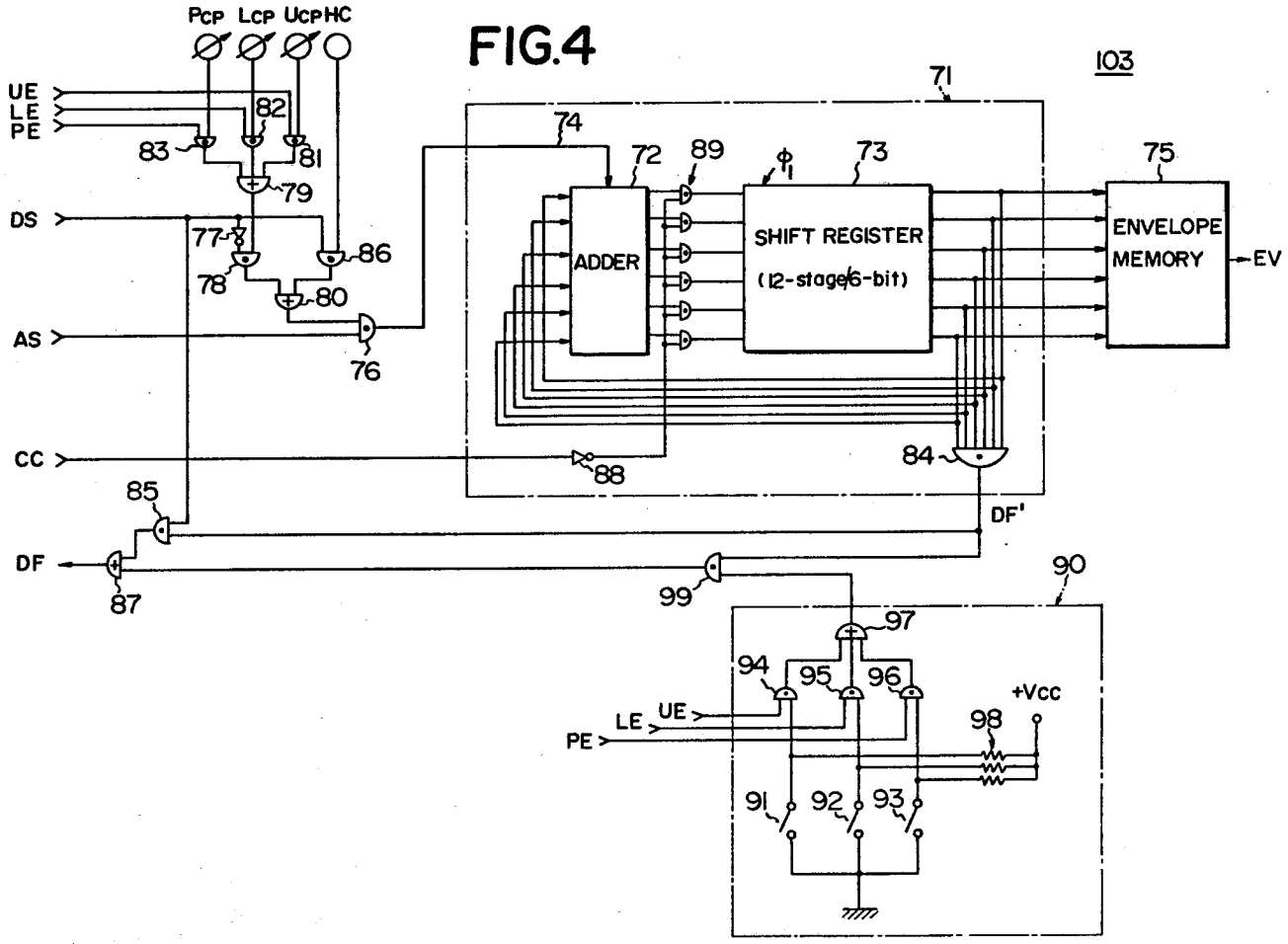
FIG. 4 is a block diagram showing an embodiment of the invention.

FIG. 4 shows the envelope generation circuit 103 in detail. The circuit 103 produces an envelope signal EV which is used for chronological controlling the amplitude of a musical tone from the start to the end of production thereof.

An envelope memory readout control counter 71 comprises an adder 72 of 6 digits and a 12-stage 6-bit shift register 73. The result of counting by the counter 72 with respect to the respective channels is held by the shift register 73 and the output of the shift register 73 is fed back to the adder 72 to be added to the count pulse appearing on a line 74 whereby cumulative counting for the respective channels is conducted in a time shared fashion.

Figure 5:
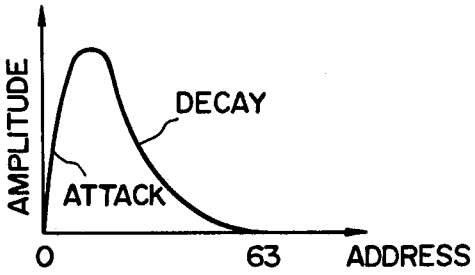
FIG. 5 is a graphical diagram showing an example of an envelope shape.

The output of the counter 71 is applied to an envelope memory 75 for successively reading out amplitude values of an envelope shape stored at addresses corresponding to the counted values. A percussive envelope shape as shown in FIG. 5 which is composed of an attack shape and a decay shape following the attack shape is divided into 64 sample points and amplitude values at the respective sample points are stored at the respective addresses ranging from 0 to 63. When the output of the counter 71 has changed from 0 to 63; one envelope shape has been read from the envelope memory 75. Assuming that the count of the first channel is now 0, the counting operation will be described with respect to the first channel.

Figure 6:
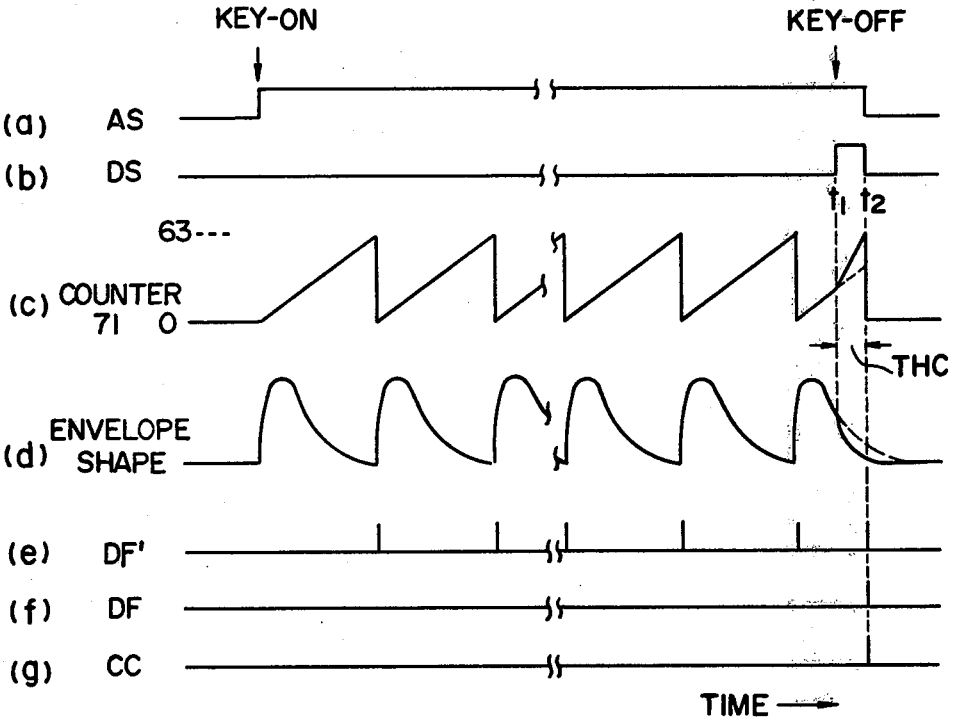
FIGS. 6(*a*) through 6(*g*) are timing charts for explaining the operation of the envelope generating circuit shown in FIG. 4.

If a certain key has been depressed and production of the tone of the key has been assigned to the first channel, the key-on signal AS is generated by the tone production assignment circuit 102 at the first channel time. This key-on signal AS is applied to an AND gate 76 in the envelope generation circuit 103. The key-on signal AS at the first channel time is as shown in FIG. 6(*a*). At this time, the key-off signal DS is not produced, i.e. a signal "0" (FIG. 6(*b*)). A signal "1" therefore is applied to an AND gate 78 through an inverter 77 to cause the AND gate 78 to select a signal from an OR gate 79. The selected signal is supplied to the AND gate 76 thrugh an OR gates 80. AND gates 81, 82, 83 to which the upper keyboard signal UE, lower keyboard signal LE and pedal keyboard signal PE from the circuit 102 are individually applied and the OR gate 79 constitute a clock select circuit. The AND gate 81 selects a clock pulse Ucp for the upper keyboard in response to the upper keyboard signal UE. The AND gate 82 selects a clock pulse Lcp in response to the lower keyboard signal LE. The AND gate 83 selects a clock pulse Pcp for the pedal keyboard in response to the pedal keyboard signal PE. These clock pulses Ucp, Lcp and Pcp are provided by suitable clock generators outside of the envelope generation circuit 103 and frequencies of these clock pulses can be varied as desired. If the key assigned to the first channel belongs to the upper keyboard, the clock pulse Ucp is selected by the AND gate 81 and delivered from the OR gate 79. Thus, the clock pulse corresponding to the kind of keyboard is supplied to the AND gate 76 and the output of the AND gate 76 is supplied to the adder 72 via a line 74 to be used as the count pulse in the adder 72.

This count pulse is cumulatively added by the counter 71 and, accordingly, the output at the shift register 73 at the first channel time increases as shown in FIG. 6(*c*). In accordance with the increase in the counted value, the address of the sample points to be called in the envelope memory 75 is shifted and, consequently, the amplitude values at the respective sample points of the envelope shape are successively read out as shown in FIG. 6(*d*). The amplitudes at the respective sample points read from the memory 75 are provided from the envelope generation circuit 103 as the envelope signal EV. When the counted value of the counter 71 has reached the maximum value of 63, reading out of one cycle of the envelope shape stored in envelope memory 75 has been completed. Since 63 in a decimal notation is equivalent to "111111" in a binary notation, the outputs of all the bits of the shift register 73 are applied to the AND gate 84 for detecting completion of reading out of one cycle of the envelope shape.

According to the present invention, production of the tone does not cease even after completion of reading out of one cycle of the envelope shape but the envelope shape is repeatedly read out. The decay finish signal DF designating cease of production of the tone is not immediately produced but the count pulse is continuously applied to the counter 71 via the line 74. The contents of the counter 71 which have been the maximum value now overflow and return to 0 and counting from 0 is resumed. Accordingly, the output of the counter 71 repeats the count from 0 to 63. In accordance with the repeated counting, the envelope memory 75 repeatedly produces the same envelope shape (FIG. 6(*d*)). Every time the counted value has reached 63, an output DF' (FIG. 6(*e*)) of the AND gate 84 becomes a signal "1" but the decay finish signal DF is not produced. This is because the signal DF' is inhibited by the AND gate 85.

The gate 85 also receives the key-off signal DS. While the key is being depressed, the key-off signal DS is "0" so that the signal DF' is inhibited and no decay finish signal DF is produced. Assume now that the key is released at time point $T_1$ in FIG. 6, and thereupon the key-off signal DS is generated. At this time, the counter 71 is still performing counting (FIG. 6(*c*)) so that the signal DF' has not been produced yet. The AND gate 78 however is inhibited whereas the AND gate 86 is enabled to gate out a high speed clock pulse HC to the line 74 via the OR gate 80 and the AND gate 76. The counter 71 is driven by this high speed clock pulse HC to perform counting so that the count increases sharply during a period THC as shown in FIG. 6(*c*). As the count increases sharply, the rate of reading the envelope shape from the envelope memory 75 increases whereby the envelope shape attenuates rapidly. Thus, a single reproduction of the tone is completed.

As the count in the counter 71 has reached 63 at a time point $t_2$, i.e. when the rapid decay of the envelope shape has been completed, the output DF' of the AND gate 84 becomes a signal "1". Since at this time the key-off signal DS is a signal "1", the output signal "1" of the AND gate 85 is applied to the OR gate 87 and the output signal "1" of the OR gate 87 is supplied to the tone production assignment circuit 102 (FIG. 6(*f*)). Upon detection of completion of production of the tone by the decay finish signal DF, the counter clear signal CC is generated by the assignment circuit 102 at this channel time (FIG. 6(*g*)). This counter clear signal CC is applied to the counter 71 in which the signal is inverted to "0" by an inverter 88 thereby inhibiting the AND gate group 89. This causes the shift register 73 to store "0" at the first storage position thereof thereby clearing the count for the particular channel.

An attack repeat selection circuit 90 is provided for selecting whether or not the attack repeat effect is to be applied by operation of switches. The example shown in the figure is capable of selecting the attack repeat effect keyboard by keyboard. A switch 91 selects an attack repeat in the upper keyboard, a switch 92 that in the lower keyboard and a switch 93 that in the pedal keyboard. The attack repeat effect is produced in the corresponding keyboard when one of these switches is closed. These switches 91–93 are respectively connected to AND gates 94, 95 and 96. These AND gates also receive the keyboard signals UE, LE and PE, respectively.

Assume by way of example that the switch 91 for the upper keyboard 91 is closed while the other switches 92 and 93 are open and that a key assigned to a certain channel (e.g. the second channel) belongs to the upper keyboard and another key assigned to another channel (e.g. the third channel) belongs to the lower keyboard. At the third channel time, the lower keyboard signal LE is generated and applied to an AND gate 95. Since the switch 92 is open and a signal "1" is applied to the gate 95 through a pull-up resistance 98, the output of the AND gate 95 is "1" which in turn enables an AND gate 99 via an OR gate 97. When the output DF' of the AND gate 84 first becomes "1" the output of the AND gate 99 becomes "1" producing the decay finish signal DF through the OR gate 87. Accordingly, only one cycle of the envelope shape is generated in the third channel and the attack repeat effect is not produced. Conversely, the upper keyboard signal UE is produced and applied to the AND gate 94 at the second channel time. Since the switch 91 is closed at this time and a signal "0" is applied to the AND gate 94, the output "0" of the AND gate 94 is applied to the AND gate 99. The signal DF' therefore is inhibited by the AND gate 99. Thus the counting operation in the counter 71 is repeated and the same envelope shape is repeatedly read from the envelope memory 75.

The envelope signal EV read from the envelope memory 75 is used for controlling the amplitude of the musical tone signal provided by the musical tone waveform memory 106 (FIG. 1).

GENERATION OF A MUSICAL TONE WAVEFORM

In accordance with key code KC provided by the tone production assignment circuit 102 and representing the depressed key, numerical information corresponding to the musical tone frequency of the note of the depressed key represented by the key code KC* is read from a frequency information memory 104 (FIG. 1).

The frequency information memory 104 previously stores a plurality of frequency information corresponding to the respective keys and is constructed of a suitable memory device such as a read-only memory. When a certain key code KC* is applied the memory 104 produces frequency information F corresponding to the key code. The instantaneous amplitude samples of the musical tone waveform are read out with a regular time interval by the address signal obtained by cumulatively adding the frequency information F with a regular time interval by a frequency counter 105. The frequency information F therefore is a digital numerical value proportionate to the musical tone frequency of the depressed key. The numerical value of the frequency information F is determined if the musical tone frequency is determined at a certain sampling rate. For example, if sampling of one cycle of the musical tone waveform is completed when a value qF obtained by cumulatively adding the frequency information F by the frequency counter 105 (where q = 1, 2, 3 . . . ) has reached 64 in decimal notation and this cumulative addition is conducted every 12 μs in which all of the channel times have completed their one cycle, the value of the frequency information F is determined by an equation $$F = 12 \times 64 \times f \times 10^{-6}$$

where f represents the musical tone frequency.

The frequency counter 105 can be composed of an adder and a 12 stage (i.e. having 12 storage positions) shift register in a similar manner to the envelope memory readout control counter 71 (FIG. 4). The counter 105 is used commonly for the respective channels in a time shared fashion in such a manner that the cumulative additions of the frequency information F being conducted in time sharing for the respective channels. The value qF is obtained by cumulatively adding the frequency information F in accordance with a constant sampling rate (12 μs) and the phase of the musical tone waveform to be read out advances every sampling time (12 μs).

The musical tone waveform memory 106 previously stores amplitude values at the respective sample points of the musical tone waveform in correspondence to the respective addresses of the memory. The value qF supplied from the counter 105 constitutes an address input for designating the address to be called in the memory 106. Thus, the amplitude values at the respective sample points are successively read out in response to the varying value qR. The musical tone waveform is formed in real time by these successively read out sample point amplitude values.

As the musical tone waveform memory, a prior art memory device of a type wherein analog voltages corresponding to amplitude values at respective sample points of a waveform can be read out as desired by switching operation of electronic switches may be used. According to this type of memory, the required switching operation is effected in response to a digital address input and an analog voltage at a sample point designated by the address input is read out.

ENVELOPE CONTROL OF THE MUSICAL TONE

The envelope memory 75 (FIG. 4) may be constructed, like the above described musical tone waveform memory 106, in such a manner that analog voltages corresponding to sample point amplitudes of an envelope shape are read out in response to a digital address input. Accordingly, the envelope signal EV (FIG. 6(*d*)) read from the envelope memory 75 is an analog voltage. This envelope signal EV is used as power voltage of a circuit for generating the along voltages of the sample point amplitudes of the musical tone waveform in the musical tone waveform memory 106. As is schmatically shown in FIG. 1, the envelope signal EV is applied directly to the musical tone waveform memory 106. Consequently, as shown in FIG. 6(*d*)), the power voltage of the sample point amplitude analog voltage generation circuit in the memory 106 varies in its level in accordance with the envelope signal EV and a musical tone waveform the amplitude envelope of which has previously been controlled in response to the variation of the envelope signal EV is read from the musical tone waveform memory 106. In the above described manner, a musical tone waveform with alternately repeating attack and decay, i.e. provided with the attack repeat effect, is produced as shown in FIG. 6(*d*).

Figure 7:
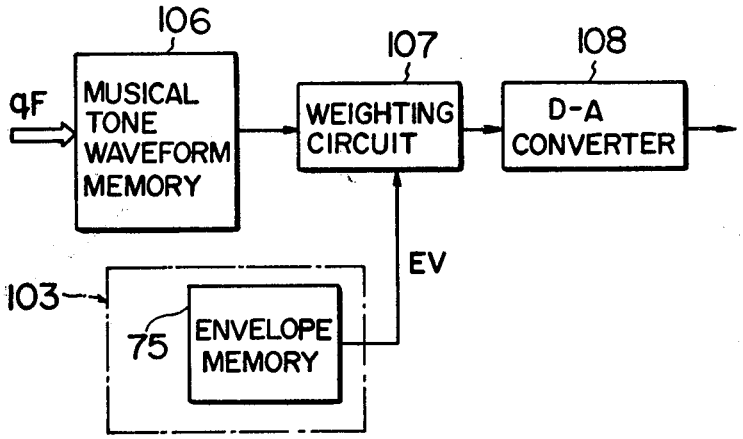
FIG. 7 is a block diagram showing another embodiment capable of controlling the musical tone amplitude by an envelope signal EV.

As the musical tone waveform memory 106 and the envelope memory 75, not only the above described type of memory but a digital type of memory such as a read-only memory storing digitally represented amplitude values may be used. In the latter case, the digital musical tone waveform signal read from the memory 106 and the digital envelope signal EV read from the envelope memory 75 are multiplied with each other in a weighting circuit 107 (e.g. a multiplier) as shown in FIG. 7 for providing the produced musical tone with an envelope characterized by the attack repeat effect. The output of the weighting circuit 107 is converted into an analog signal by a digital-to-analog converter 108. If a voltage-controlled type variable gain amplifier is used as the weighting circuit 107, the envelope signal EV and the musical tone waveform signal from the memory 106 must be supplied in analog voltage and consequently the digital-to-analog converter 108 is omitted.

The attack repeat effect for multiple tones

According to the present invention, if plural keys are successively depressed one after another and tones for these keys are produced with one tone being superposed upon another, a musical effect similar to arpeggio is produced.

Figure 8:
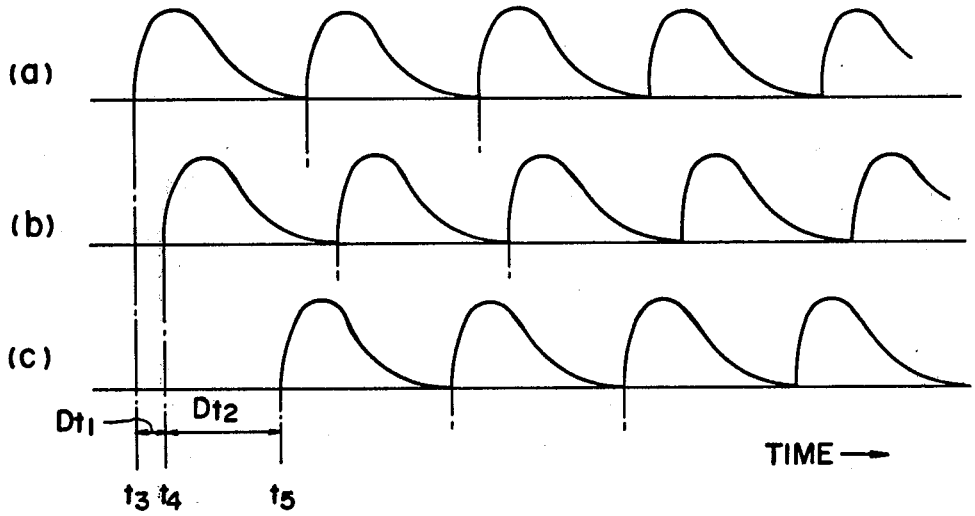
FIGS. 8(*a*) through 8(*c*) are graphical diagrams for explaining the attack repeat effect produced by a plurality of tones.

Referring to FIG. 8, three keys, for example, are depressed one after another at time points $t_3$, $T_4$ and $T_5$. Assuming that the key depressed at the time point $t_3$ is assigned to the first channel, FIG. 8(*a*) shows the first channel time only. Assuming also that the key depressed at the time point $t_4$ is assigned to the second channel, FIG. 8(*b*) shows the second channel time only. Likewise, assuming that the key depressed at the time point $t_5$ is assigned to the third channel, FIG. 8(*c*) shows the third channel time only. If the three keys belong to the same keyboard, or if the clocks Ucp, Lcp and Pcp for the respective keyboards are produced at the same rate, time required for reading out one envelope shape is the same with respect to the three keys. Accordingly, the attack of each envelope shape is repeated maintaining time lags $Dt_1$, $Dt_2$ between the start of depression of the three keys. In other words, the attack repeat effect is produced by each of the tones of the depressed keys with the time lags $Dt_1$, $Dt_2$ therebetween. By this arrangement, a musical effect similar to arpeggio produced by sounding plural tones in rapid succession can be obtained.

The above described envelope memory readout control counter 71 may be substituted by other types of circuit adapted for controlling calling of the envelope memory. For example, a shift register having shift stages equal in number to the number of the addresses of the envelope memory 75 may be used. A signal "1" is held in a single stage of this shift register and the pulse Ucp, Lcp or Dcp selected by the key-on signal AS is used as a shift control clock. If the attack repeat effect is desired, a signal "1" delivered from the final stage of the shift register corresponding to the final address of the memory 75 is fed back to the first stage so as to repeat reading of the envelope shape. If the attack repeat effect is not desired, this is achieved by preventing application of the signal "1" from the final stage to the first stage of the shift register.

What is claimed is:

1. A polyphonic electronic musical instrument having an attack repeat effect, comprising:

a set of tone selection keys;

a single tone generator for producing a musical tone in accordance with a key code specifying the frequency of that tone;

tone production assignment means for storing the key codes of one or more tones selected by depression of said keys and for repeatedly, sequentially supplying said stored key codes to said single tone generator in consecutive time slots corresponding to a plurality of channels so that said single tone generator thereby produces said one or more tones in a time-shared fashion;

a single envelope memory storing a predetermined envelope shape;

read out means for reading out said envelope shape from said single envelope memory individually with respect to each of said plurality of channels in synchronism with said consecutive slots, said read out means comprising a time shared counter of modulo m, where m corresponds to the number of storage addresses in said envelope memory, said counter having;

a shift register having a number of stages corresponding to the number of said channels, each stage being capable of storing an address code for said envelope memory, one stage of said shift register being connected to said read out means so that said envelope memory is read out at the address provided from said connected one stage, said shift register being shifted in unison with occurrence of each channel-corresponding time slot;

an envelope clock pulse source; and adder means, connected between the output stage and the input stage of said shift register to reenter the address code from said output stage back into said input stage, for incrementing the reentered address code upon occurrence of a pulse from said envelope clock pulse source, each stage of said shift register being reset to zero each time that it has been incremented to a count of m; and envelope control means, connected to said read out means and to said tone generator, for controlling the amplitude envelope of each produced musical tone in accordance with the corresponding read out envelope shape.

2. An electronic musical instrument as defined in claim 1 further comprising:

a detection circuit for detecting completion of reading out of one cycle of said envelope shape by said read out means in any channel, and for producing a corresponding end of cycle detection signal; and selection switch means for selecting whether or not an end of cycle detection signal from said detection circuit should be applied to said tone generator to terminate production of the tone in the corresponding channel, whereby the amplitude envelope of each produced musical tone has either a single envelope shape or successively repeated envelope shapes in accordance with the switching operation of said selection switch means.

3. An electronic musical instrument having a single tone generator and a single envelope memory that are time shared so as to produce plural tones in respective channels defined by a repetitive set of time slots, and having circuitry for controlling the envelope of a musical tone produced by said tone generator in accordance with a supplied envelope defining signal, the improvement for providing an attack repeat effect comprising:

an envelope memory storing a set of envelope scale factors which, when read out, constitute said envelope defining signal;

a counter of modulo m, where m corresponds to the number of storage addresses in said envelope memory, said counter counting repetitively from zero through m as clock pulses are applied thereto;

readout means for reading out from said envelope memory the envelope scale factor stored at the address specified by the contents of said counter, said read out envelope scale factor being supplied to said envelope controlling circuitry; and a clock pulse source connected to said counter, clock pulses from said source incrementing said counter so as to cause readout of scale factors from consecutive addresses of said envelope memory at a rate established by said clock pulse source, the resetting and repeated counting of said modulo m counter after occurrence of each m pulses from said clock pulse source thereby causing repeated supply of said envelope defining signal to said envelope controlling circuitry so that an attack repeat effect is achieved, and wherein said counter comprises:

a recirculating shift register having a number of stages equal to the number of said channels, said register being shifted in unison with said time slots, each stage containing an envelope memory address for a corresponding channel, and time shared adder means for incrementing the contents of each stage in accordance with clock pulses from said source, so that each stage and the time shared adder means together constitute a counter of modulo m for the corresponding channel.

4. An electronic musical instrument having a tone generator and circuitry for controlling the envelope of a musical tone produced by said generator in accordance with a supplied envelope defining signal, the improvement for providing an attack repeat effect comprising:

an envelope memory storing a set of envelope scale factors which, when read out, constitute said envelope defining signal;

a counter of modulo m, where m corresponds to the number of storage addresses in said envelope memory, said counter counting repetitively from zero through m as clock pulses are applied thereto;

readout means for reading out from said envelope memory the envelope scale factor stored at the address specified by the contents of said counter, said read out envelope scale factor being supplied to said envelope controlling circuitry;

a clock pulse source connected to said counter, clock pulses from said source incrementing said counter so as to cause readout of scale factors from consecutive addresses of said envelope memory at a rate established by said clock pulse source, the resetting and repeated counting of said modulo m counter after occurrence of each m pulses from said clock pulse source thereby causing repeated supply of said envelope defining signal to said envelope controlling circuitry so that an attack repeat effect is achieved, a keyboard, said tone generator beginning tone production upon depression of a keyboard key;

a detector for detecting the resetting of said modulo m counter when a count of m has been reached, each such resetting corresponding to completion of read out of a full set of envelope scale factors from said envelope memory, gate means, connected to said keyboard and to said detector, for producing a tone termination signal upon detection of the resetting of said modulo m counter after release of said depressed key, said termination signal ending tone production by said tone generator, and high speed clock means, operative upon release of said key, for thereafter providing to said counter clock pulses of a rate greater than, and instead of, said pulses from said source, whereby the final amplitude envelope scale factors will be more rapidly read out from said envelope memory so as sooner to terminate tone production.

* * * * *